United States Patent [19]

Klie et al.

[11] Patent Number: 4,679,533

[45] Date of Patent: Jul. 14, 1987

[54] PNEUMATIC STARTER

[75] Inventors: Juergen Klie; Hans-Wilhelm Weiss, both of Sprockhoevel, Fed. Rep. of Germany

[73] Assignee: G. Duesterloh GmbH, Sprockhoevel, Fed. Rep. of Germany

[21] Appl. No.: 830,683

[22] Filed: Feb. 18, 1986

Related U.S. Application Data

[63] Continuation-in-part of Ser. No. 644,128, Aug. 23, 1984, abandoned.

[30] Foreign Application Priority Data

Aug. 23, 1983 [DE] Fed. Rep. of Germany ..... 3330314

[51] Int. Cl.[4] ..... F02N 7/08

[52] U.S. Cl. ..... 123/179 F; 91/53

[58] Field of Search ..... 123/179 F; 91/53; 60/625

[56] References Cited

U.S. PATENT DOCUMENTS 3,182,650 5/1965 Heckt ..... 123/179 F
3,616,785 11/1971 Smith et al. ..... 123/179 F
3,794,009 2/1974 Wenrich et al. ..... 123/179 F

FOREIGN PATENT DOCUMENTS 3020930 12/1981 Fed. Rep. of Germany .

OTHER PUBLICATIONS

"Dubbels Taschenbuch für den Maschinenbau"by F. Sass, Ch. Bouche and A. Leitner, 1966, Berlin, Heidelberg, New York.

Düsterloh Catalog, pp. 115-301.1, 12.3820.1, L51-307 E.

*Primary Examiner*—Andrew M. Dolinar
*Attorney, Agent, or Firm*—Michael J. Striker

[57] ABSTRACT

A pneumatic starter arrangement includes a pneumatic actuator having a piston supporting for axial displacement a starter pinion to engage or disengage a flywheel gear of an internal combustion engine. A pressure air source is connected to the actuator via a supply branch conduit including a pilot valve. A starter motor which rotates the starter pinion is connected to the pressure air supply via a main control valve. To insure flawless engagement of the starter pinion with the flywheel gear, a bypass conduit with a relief valve is connected between the supply branch conduit and the starter motor. The main control valve is normally in its closed position and is controlled by a switching conduit leading to a port in the pneumatic actuator so that when the piston of the actuator displaces the starter pinion in its fully engaged position, the main control valve is switched on and the starter motor is activated. When the starter pinion fails to engage the flywheel gear the relief valve opens and the starter pinion is slightly retracted and the engagement attempt is repeated so long until full engagement is achieved. A resistance-to-flow element is conneced to the bypass conduit.

18 Claims, 9 Drawing Figures

PNEUMATIC STARTER

CROSS REFERENCE TO RELATED APPLICATION

The present application is a continuation-in-part of application Ser. No. 644,128 filed Aug. 23, 1984 now abandoned.

BACKGROUND OF THE INVENTION

The present invention relates in general to a pneumatic starter arrangement for an internal combustion engine, and in particular to an arrangement of the kind which includes a pneumatic starter motor, a gear train including an axially retrievable pinion for transmitting rotary movement of the starter motor to the internal combustion engine, a pneumatic actuator having a piston coupled to the pinion for controlling the axial movement of the latter, a source of pressure air, a first conduit connecting the pressure air source to the actuator, a second conduit connecting the pressure air source to the starter motor, a main control valve in the second conduit, a pilot valve in the first conduit and a bypass conduit connecting the starter motor to the actuator.

A pneumatic starter arrangement of this kind is known from the German Pat. No. 3,020,930 and its advantageous quality has been already proven in practice. On the other hand, however, it has been also found in practice that in the automatic course of the starting process meshing errors still may occur. This happens for example in the case when the starting process is incorporated in a chain of automatically running, preprogrammed processes. The enforced functions following in an automatic operation require therefore in absolutely reliable and flawless operational conditions which however cannot be met in the starting process.

Meshing errors, for example can occur in the case when the teeth of the starter pinion and/or of the flywheel of the internal combustion engine to be started are damaged and the starter pinion is clamped in the teeth of the flywheel.

It may also happen during the starting operation that during the engagement of the starter pinion with the teeth of the flywheel the beveled leading edges of the teeth of the starter pinion when considered in the rotational direction of the latter, and the trailing edges of the teeth of the flywheel abut against each other and consequently inspite of relatively small bevel of the starter pinion and flywheel gears, the latter may become clamped one with the other.

SUMMARY OF THE INVENTION

It is therefore a general object of the present invention to overcome the aforementioned disadvantages.

More particularly, it is an object of the invention to provide an improved pneumatic starter arrangement of the above described kind in which the number of movable parts is reduced so as to minimize the danger of malfunction.

Another object of this invention is to provide such an improved pneumatic starter arrangement which enables a simple, inexpensive, and easy to manufacture combination of control valves.

Still another object of this invention is to eliminate expensive diving channels and bores particularly within the valve box assigned to the starter motor.

Yet another object of this invention to provide such an improved arrangement which avoids the danger of the dynamic overloads of individual component parts due to the damped operation of all control valves, resulting in a higher operational reliability.

Still another object of this invention is to lower the comsumption of pressure air.

The above and other objects of the invention are attained by a pneumatic starter arrangement for use in connection with an internal combustion engine having a flywheel gear, comprising a pneumatic starter motor, an axially retrievable pinion engageable with the flywheel gear, a pneumatic actuator having a spring-biased piston coupled to the pinion for imparting the axial motion to the latter, a supply branch conduit connecting a pressure supply source to the actuator, a main supply conduit connecting the pressure supply source to the starter motor, a main control valve provided in the main supply conduit, a pilot valve provided in the supply branch conduit between the pressure supply source and the actuator, means for controlling the position of the main control valve in response to the position of the piston of the pneumatic actuator, a bypass conduit connecting the starter motor to the supply branch conduit, a relief valve positioned in said bypass conduit and being designed such that its opening pressure is substantially greater than its closing pressure, and resistance-to-flow means connected to said bypass conduit, the ratio of combined air volumes of all pressure air conduits between the starter motor, the main control valve and the relief valve and between the starter motor, the resistance-to-flow means and the pressure-relief valve on the one side, and the pilot valve, the pneumatic actuator and the relief valve, on the other side, being between 3:1 and 15:1.

The invention has the advantage that the number of functional units is smaller than in the prior art solutions and the manufacturing cost of the arrangement are thus reduced. All control valve circuits are provided with damping means which prevent dynamic overload. Deviations in manufacturing tolerances or minor installation errors cannot result in a malfunction of the arrangement. The pressure air consumption is lowered because for maintaining the desired functional cycles such as axial motion of the starter pinion and the rotary movement of the starter motor, no or negligible pressure air is exhausted which in prior art arrangement was lost without use and necessitated relatively large air accumulator to avoid excessively fast charge.

In initiating the starting process, the pilot valve is first activated either immediately by hand or by a remote control device. By switching on the pilot valve, pressure air is admitted in the supply conduit connected to the pneumatic actuator. When pressure acting on the piston of the actuator reaches about 2 bar (the starter being designed for a pressure range between about 5 to 10 bar), the starter pinion begins to move in its axial direction toward the teeth of the flywheel of the engine. If the teeth of the starter pinion smoothly engage the teeth of the flywheel, then the pressure in the actuator is sufficient to complete the engagement of the starter pinion into its end position. In doing so, the pressure in the pneumatic actuator rises to about 3 bar. When the piston of the actuator overrides a connection of a conduit leading to switching means of the main control valve and of the auxiliary control valve, then pressure air applied to switching connection opens the main control valve and closes the auxiliary control valve and the starter motor is made to rotate with its full speed.

Different starting conditions are encountered when the teeth of the starter pinion strike against the faces of the teeth of the flywheel. In this case air pressure in the supply conduit to the actuator rises to about 4 bar and the relief valve connected via the normally open auxiliary control valve to the intake port of the starter motor, is opened. Due to the opening of the relief valve a pressure balance is established between the air spaces (channels, bores, conduits, etc.) at both sides of the relief valve and the air pressure in the air supply conduit to the actuator drops to about 1 bar whereby the relief valve is returned to its closed position. At the same time, due to the pressure decrease in the actuator the piston and the starter pinion coupled therewith are reset a small distance away from the teeth of the flywheel. Simultaneously, pressure in the conduit between the main control valve and the starter motor is increased approximately in a reverse proportion to the combined air volume of all conduits at both sides of the release valve.

In the alternative solution, the expansion takes place also at the exhaust side of the starter motor provided that the exhaust side is equipped with an exhaust air restricting sleeve or collar or other device which makes it possible to develop a small dynamic pressure. In this case the main control valve is designed as a 3/2 directional control valve which depressurizes the conduit leading to the starter motor.

By suitably selecting the air volumes of all conduits at both sides of the relief valve, pressure applied to the rotors is sufficient to impart a minute rotary movement to the starter motor and the engagement attempts of the starter pinion are repeated in the before described manner until the teeth of the starter pinion find their way to mesh the teeth of the flywheel and the full pressure from the air supply conduit is admitted via the working space of the actuator to the switching means of the main control valve, thus causing the latter to open and applying full pressure to the starter motor which begins to reotate at its full speed.

An expansion in the exhaust side of the starter motor is of advantage particularly in the case when a free wheel is employed in the meshing gear train which during engagement and disengagement of the pinion is axially shifted. The free wheel is provided with spring biased clamping bodies and due to the preceding momentary loads bracing may occur in the free wheel which may impair the axial movability. However, if the exhaust side of the starter motor is expanded the rotary direction of the free wheel is reversed and the clamping bodies are repeatedly released. Inasmuch as the starter pinion has not yet been brought in mesh with the fly gear, the spring bias of the clamping bodies of the free wheel and friction in the meshing gear train are sufficient for imparting the desired small rotary motion to the starter pinion.

In order to disengage the starter pinion from the flywheel it is sufficient only to release the pilot valve so as to depressurize the supply conduit to the pneumatic actuator whereby the resetting spring acting on the piston of the actuator displaces the starter pinion in its initial position.

The invention is particularly advantageous during the so-called "cranking" operation. In this mode of operation, a diesel engine is rotated at a very low speed and remains unignited. This function is necessary during maintenance and repair work when the crank shaft of the diesel engine is to be brouth in a predetermined angular position. Especially in diesel engines installed on ships, during the cranking operation decompression valves on the cylinders are open and water present in the cylinders or in the pipes and chambers is flown out so that any damage of the engine be precluded.

In principle during the starting process pressures present in the control system of the starter arrangement of this invention must be always held lower than pressure at the control connections. Therefore, the correct ratio of combined air volumes at both sides of the pressure relief valve is of essential importance. By proper adjustment of this ratio, the pressure amplitudes at the starter motor can be determined. The desired pressure peaks are in the range of about 0.2 to 1 bar. In order to obtain such pressure peaks, the pressure air volumes at one side of the relief valve are dimensioned such as to amount to between 3:1 and 15:1 with respect to pressure air volumes at the other side of the relief valve. As a rule, it is desirable to keep the volume of the expansion space as small as possible.

The pneumatic starter arrangement of this invention employs a pressure relief valve which has a defined behavior.

In one of the embodiments of this invention, the opening pressure of the relief valve is about between twice to six times as great as its closing pressure and the ratio of air volumes in all channels, bores, conduits and the like between the starter motor, the main control valve and pressure relief valve on the one side, and the pilot valve, the pneumatic actuator and the relief valve on the other side is about 4:1.

The conduit between the pilot valve and the pressure air source includes a throttle which insures that pressures occurring in the control system of the arrangement during the starting process remain always smaller than control pressure at the starter motor.

The normally open auxiliary control valve is a two-two directional control valve connected in series with the relief valve in the bypass conduit, prevents particularly in the "cranking" mode of operation an unintended retrieval of the starter pinion in the event when pressure in the conduit between the main control valve and the starter motor is momentarily strongly reduced. In this condition, the auxiliary control valve is closed, thus preventing the pressure release in the pneumatic actuator in the case that the pressure relief valve be opened.

In the case of disengagement of the starter pinion when the supply conduits to the pneumatic actuator is depressurized, the auxiliary two-two directional control valve is brought in its normally open initial position whereby the resetting spring in the pneumatic actuator disengages the starter pinion from the gear of the flywheel.

In another embodiment of this invention, a throttle is arranged in the switching conduit leading between a connection in the cylinder of the pneumatic actuator and the switching connector of the main control valve, whereby a discharge port of the relief valve is connected to the switching conduit upstream of the throttle. This construction provides also a pressure relief during the meshing process, namely via the switching conduit leading to the switching connection of the main valve when the biasing spring space of the actuator is pressure relieved. When the piston of the actuator is displaced to the final engaging position of the pinion, the switching conduit is supplied with pressure air which acts on the pressure relief valve in the direction in which the connection between air supply conduit, the actuator and the conduit between the main control valve and the starter motor is closed. In this embodiment the auxiliary two-two directional control valve can be dispensed with even in the case when the starter arrangement of this invention is employed for "cranking" a diesel engine. The throttle in the switching conduit leading to the switching connection of the main valve prevents pressure drop both in the switching conduit and in the supply conduit to the actuator. The throttle in the switching conduit thus prevents an unintended retrieval of the piston of the actuator.

In a further embodiment of this invention, the switching conduit is connected to the air supply conduit via a back pressure valve which relieves overpressure in the switching conduit when the auxiliary two/two directional control valve is switched over into its closed position. In the embodiment employing the throttle in the switching conduit, the back pressure valve connects the air supply conduit to the actuator with a conduit leading from the throttle to the switching connection of the main control valve.

In another preferred embodiment of this invention, the pressure relief valve includes a housing formed with an intake port and a discharge port, a piston movable in the housing past the discharge port and being spring biased against the intake port, and a closing body carried by the piston against the intake port. The sealing surface of the closing body determines the opening pressure of the relief valve. The closing pressure is computed from the end face of the piston which is twice to six times as large as the sealing surface of the closing body. In view of the substantially larger opening pressure in comparison with the closing pressure of the relief valve, the latter is provided with a narrow bleeder gap between the piston and the housing in the closing position of the piston. The intake port in the housing of the relief valve is connected to the supply conduit for the pneumatic actuator and is controlled by the closing body in the form of a ball which guarantees the desired opening/closing behavior of the relief valve.

Minor leakages which may occur at the closing body in the switched off position of the relief valve are compensated by the bleeder gap. The bleeder gap insures that no pressure worth mentioning builds up at the piston end face exposed to the supplied pressure air in the closed position of the valve.

If the pressure in the intake port of the relief valve exceeds the spring force biasing the piston such as for example an equivalent of 4 bar, then the closing body is displaced from its seat and a strong air stream which can no longer be compensated by the bleeder gap, acts on the piston of the relief valve. As a consequence pressure acting on the end face of the piston displaces both the closing body and the piston into their end position in the opening direction. Therewith the communication between the pressure air supply conduit and the bypass conduit is established and the resulting pressure balance lasts so long until pressure in the relief valve drops to a closing pressure for example to 1 bar. The spring chamber of the relief valve accommodating the biasing spring is also proviced with a channel leading to the outer atmosphere.

In a modification of the release valve, an opening piston formed with a piston rod is arranged between the intake port and the closing body of the relief valve, while the bleeder gap is omitted. This modification of the relief valve can be used both in the control system employing the auxiliary two/two directional control valve in the bypass conduit as well as in the embodiment using the throttle in the switching conduit between the pneumatic actuator and the switching connection of the main valve.

In yet another embodiment, the space of the relief valve accommodating the biasing spring for the piston and the pressure air supply conduit are interconnected via an annular gap between the piston and the housing and via longitudinal groove in the rim of the piston, and the space adjoining the side of the opening piston provided with the piston rod communicates with the switching conduit leading to the switching connection of the main valve. As a result, there is always a pressure balance between the spring space and the intake port of the relief valve.

The main control valve is preferably of the type which includes a slider guided in a housing and sealed by elastomeric sealing elements. The slider is at one end thereof biased by a biasing spring and at the opposite end communicates with the switching connection. The air volume of the pressure conduit between the main control valve and the starter motor is designed as small as possible. Since neither the opening nor the closing function of the main control valve are affected by pressure in the main pressure air supply conduit or in the conduit between the main control valve and the starter motor, the slider is designed to perform relatively slow control movements. These movements are adjusted by the provision of a suitable damping bore which connects the return spring space of the main control valve with the outer atmosphere. In this manner the pressure gradient during opening of the main valve can be substantially reduced and the dynamic overload of a free wheel forming a component part of the gear train, is avoided.

The diameter of the annular gap is very small in order to prevent extraction of a sealing element between the annular space and a connection for the main air supply conduit. The sealing element need not be guided over sharp edges of the connecting bore for the conduit leading to the starter motor.

In the embodiment of the main control valve having an axial pressure air flow, a stepped piston is used instead of a slider. To open the main control valve, the switching connection is supplied with air pressure. The switching conduit opens in the actuator at the side of the piston which is remote from the end face of the piston. If pressure air is supplied from the main supply conduit, a biasing spring is no longer needed since in this case, the main control valve is automatically opened or closed in dependency on the pressure conditions in the switching conduit.

In the preferred embodiment of this invention, the opening pressure of the relief valve is between 40 to 80% of the pressure at the pressure air source, the closing pressure of the relief valve is between 17 to 50%, preferably about 25% percent of the opening pressure, the switch-over pressure of the two/two auxiliary control valve is between 12 to 50%, preferably about 38% of the opening pressure, the switchover pressure of the main control valve is about 15 to 90%, preferably about 50% of the opening pressure whereby the switchover pressure of the main control valve is greater than the switchover pressure of the auxiliary control valve, the pressure spring equivalent of the pneumatic actuator is in disengaged condition of the pinion about 20 to 60%, preferably about 50% of the opening pressure of the relief valve, whereby the pressure spring equivalent is greater than the closing pressure of the relief valve, the pressure spring equivalent of the pneumatic actuator is in closed position thereof about 30 to 90%, preferably about 75% of the opening pressure of the relief valve and the biasing force of the back pressure valve is about 5% of the opening pressure of the relief valve. In the preferred embodiment, the opening pressure of the relief valve is 4 bar, the closing pressure of the relief valve is 1 bar, the spring force equivalent of the actuator in disengaged condition is 2 bar, the spring force equivalent of the actuator in engaged condition is 3 bar, the switchover pressure of the two/two auxiliary directional control valve is 1.5 bar, the bias of the back pressure valve is 0.2 bar, the switchover pressure of the main control valve is 2 bar and the ratio of air volume behind and before the relief valve is 4:1.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
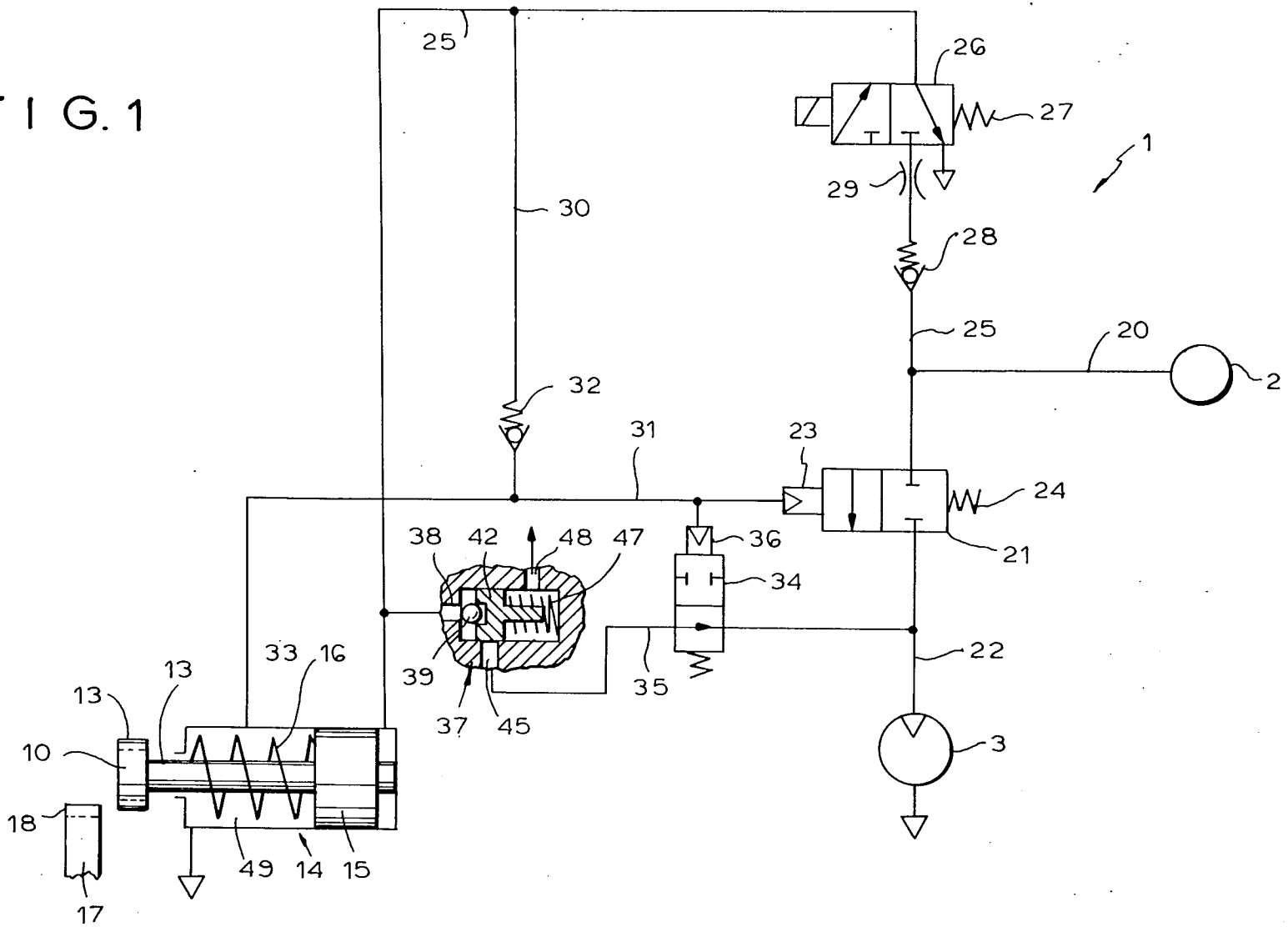
FIG. 1 is a schematic circuit diagram of one embodiment of a pneumatic starter arrangement for an internal combustion engine.
Figure 2:
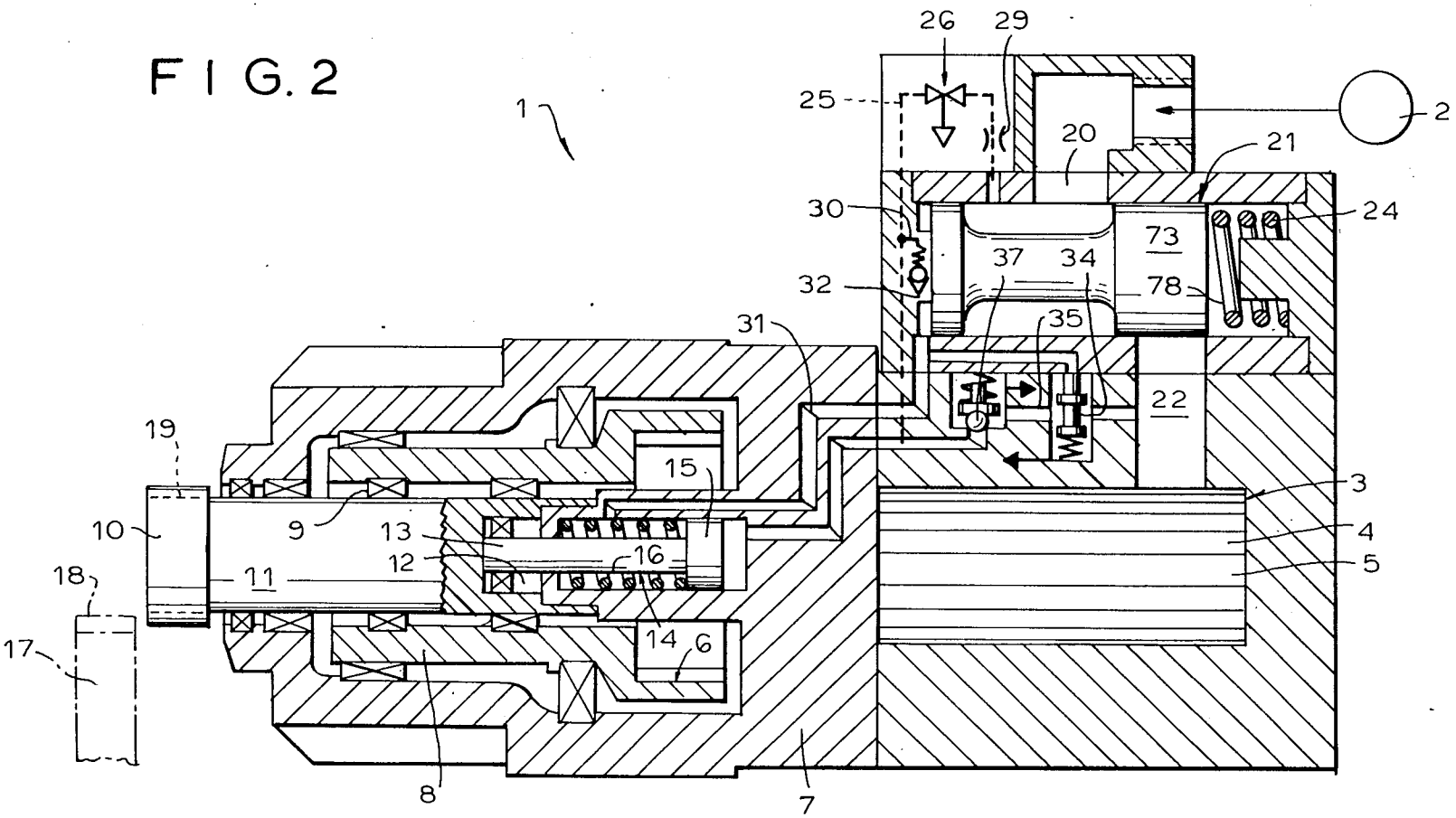
FIG. 2 is an axial section of an example of an actual embodiment of the starter arrangement of FIG. 1.
Figure 3:
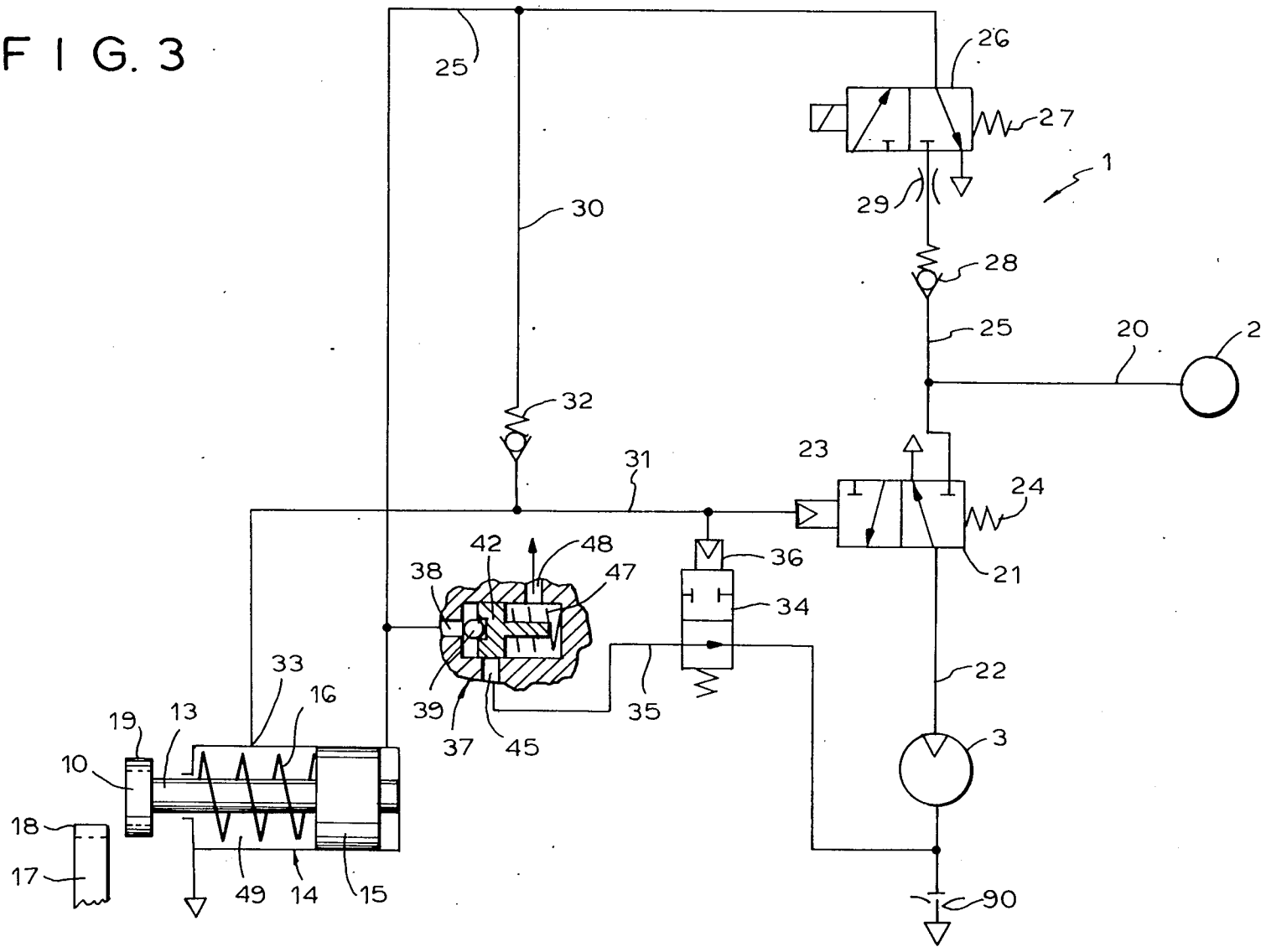
FIG. 3 is a circuit diagram of a modification of the pneumatic starter arrangement of FIG. 1.

Referring firstly to the circuit diagram of FIGS. 1 and 3 and to a structural embodiment shown in FIG. 2, reference numeral 1 denotes a pneumatic starter arrangement for an internal combustion engine provided with a flywheel 17 having teeth 18 on its periphery. The arrangement includes a starter motor 3 which is equipped with two rotors 4 and 5. A non-illustrated driving pinion of the starter motor 3 engages an internal gear 6 of a hollow shaft 8 which is supported for rotation in a housing 7 of the starter 1. The hollow shaft 8 is coupled via free wheel 9 to a starter shaft 11 which at its free end carries a starter pinion 10. The opposite end of the starter shaft 11 is formed with a recess through which an end of piston rod 13 is rotatably connected. The other end of the piston rod is connected to piston 15 of a pneumatic actuator 14. The opposite larger end face of the piston 15 delimiting a pressure chamber of the actuator 14 is attacked by pressure air and a helical pressure spring 16 arranged around the piston rod 13 acts on the piston 15 in opposite direction. Accordingly, when no pressure is present in the working chamber, the piston 15 together with starter shaft 11 and starter pinion 10 are axially displaced to an initial position to the left.

The flywheel 17 of a non-illustrated internal combustion engine has teeth 18 which are engageable with teeth 19 of the starter pinion 10.

A main pressure air supply conduit 20 leads from the pressure air source 2 to a main control valve 21 and therefrom via a pressure conduit 22 to an intake port of starter motor 3. The main control valve 21 is spring biased at one end thereof with a return spring 24 and at the opposite end, it is provided with a pneumatic switching connection 23. The main control valve is in the form of a two/two directional control valve (FIG. 1) or a three/two directional control valve (FIG. 3). The resetting spring 24 normally urges the valve 21 in its closing position in which the starter motor 3 is disconnected from the source 2 of pressure air.

A supply conduit 25 branches from the main air supply conduit 20 and includes a pilot valve 26 which serves for the initiation of the starting process. The pilot valve 26 is operated either directly by hand or remotely via a non-illustrated control device. In the initial position of the pilot valve 26, a resetting spring 27 urges the pilot valve into a position in which the supply branch conduit 25 is pressure relieved.

From FIGS. 1 and 3 it will be further seen that the supply branch conduit 25 also includes a back pressure valve 28 and a throttle 29 connected in series upstream of the pilot valve 26.

In order to initiate the meshing of the starter pinion 19 with the flywheel 17, the pilot valve 26 is first displaced in a position in which the pressure air source 2 is connected to the supply branch conduit 25. Pressure air flows through the back pressure valve 28, the throttle 29, the pilot valve 26 into the working space of the pneumatic actuator 14. In addition, a pressure relieving conduit 30 including a backpressure valve 32 is partially filled with pressure air. A switching conduit 31 connects a port 33 in the spring chamber 49 of the actuator 14 to the back pressure valve 32 and therefrom to the pneumatic switching connection 23 of the main control valve 21. The back pressure valve 32 closes in the direction to the switching conduit 31.

When pressure acting on piston 15 of the actuator 14 has reached about 2 bar, the piston 15 together with starter pinion 10 start moving in the direction toward the flywheel 17.

At this point, different situations are encountered:

If teeth 19 of the starter pinion 10 engage the teeth 18 of the flywheel 17, pressure in the working space of actuator 14 is sufficient to displace axially the piston 15 and the starter pinion 10 into its engaged end position in mesh with the fly gear 18 whereupon pressure in the working space of the actuator 14 reaches about 3 bar. When piston 15 overrides the connecting port 33 of the switching conduit 31, the full pressure in the working chamber of the actuator is supplied into the switching conduit 31 and activates a pneumatic switching connection 36 of an auxiliary two/two directional control valve 34 which controls a bypass conduit 35 connecting the supply branch conduit 25 with the conduit 22 between the main control valve 21 and the starter motor 3.

Simultaneously the pneumatic switching connection 23 which is also connected to the switching conduit 31, causes the main control valve 21 to switch over into an open position. As a consequence, full flow of pressure air is admitted in the starter motor which starts rotating at full speed.

If, however, the teeth 19 and 18 of the starter pinion and of the flywheel reach each other with their end faces, pressure in the supply conduit 25 starts increasing whereby at a pressure of about 4 bar a pressure relief valve 37 connected in bypass conduit 35 between the supply conduit 25 and the auxiliary two/two control valve 34, opens. At this moment a pressure balance is produced in spaces at both sides of the relief valve 37, whereby pressure in the working space of actuator 14 and in the supply branch conduit 25 drops to about 1 bar and the pressure relief valve 37 restores its closing position. At the same time the piston 15 is moved by the force of biasing spring 16 a little bit back toward its initial position so that starter pinion 10 is spaced apart a small distance from the flywheel 17. Simultaneously, pressure in conduit 22 leading to the starter motor 3 is increased by an amount which is approximately in reverse proportion of the ratio of the air volumes enclosed at both sides of the pressure relief valve 37. At a suitable selection of these volumes the pressure in conduit 22 is sufficient to impart a small rotary motion to the starter motor 3. The beforedescribed process repeats itself so long until the teeth 19 of starter pinion 10 engage the teeth 18 of the flywheel 17. Thereafter the control system operates in accordance with the first described process.

To disengage the pinion from the flywheel, the pilot valve 26 is released. As a result, the air supply branch conduit 25 and the pressure relieving conduit 30 are without pressure and the switching conduit 31 is pressure relieved via the back pressure valve 32. Accordingly, the two/two auxiliary control valve 34 is returned to its initial open position and spring 16 in actuator 14 return the starter pinion 10 out of engagement with the gear 18 of the flywheel.

In the so-called "cranking" mode of operation pressure in the conduit 22 may strongly decrease in time. Nevertheless, no unintentional retrival of the starter pinion 10 from the flywheel gear 18 will occur because the closed auxiliary control valve 34 prevents a pressure reduction in the actuator 14 even in the case when the pressure relief valve 37 is open.

In the embodiment of the pressure relief valve 37 illustrated in FIGS. 1 through 4, there is provided an intake port 38 which in order to obtain the desired opening or closing behavior of the relief valve, cooperates with a ball-shaped closing body 39. The intake port or bore 38 communicates with the pressure air supply branch conduit 25. Minor leakages which may occur in the closed condition of the valve around the closing body 39 are discharged through a narrow bleeder gap 40 (FIG. 5) so that the working face 41 of piston 42 of the relief valve 37 cannot be attacked by any effective pressure.

If pressure in intake port 38 of the relief valve 37 exceeds the counteracting force of biasing spring 43, which condition may occur at 4 bar, for example, then the closing body 39 is displaced from its seat 44 and a considerable pressure air stream acts against the front face 41 of the piston 42 whereby the bleeder gap 40 is insufficient for discharging this large air flow. Consequently, a pressure built up on the face 41 of the piston 42 and the latter together with the closing body 39 are displaced into an opening position. In the open position a pressure balance is established at both sides of the relief valve 37, namely at the supply branch conduit 25 and the bypass conduit 35 which communicates with discharge port 45 of the relief valve. The pressure equalization takes place so long until the pressure in the relief valve 37 drops to a closing pressure, that is to about 1 bar. The housing of the relief valve 37 is designated by reference numeral 46.

The opening pressure of the relief valve, namely the pressure required to displace the closing body 39, is determined by the sealing surface of the closing body whereas the closing pressure of the relief valve is determined by the area of the end face 41 of the piston 42 which is twice to six times as large as the sealing area of the closing body.

The spring space 47 of the relief valve 37 is connected to the outer atmosphere via a channel 48.

The correct ratio of air volume that means of volume occupied by all conduits, channels, ports and the like at both sides of the relief valve 37 is an essential factor in the arrangement of this invention inasmuch as this ratio determines the pressure amplitude acting on the starter motor 3. Desired pressure amplitude peaks at the motor are in the range of about 0.2 to 1 bar. To obtain this amplitude range, the ratio of air volumes at the two sides of the relief valve 37 must be between 3:1 and 15:1, preferably 4:1.

In the pneumatic circuit, shown in FIG. 3, a resistance-to-flow element 90 is provided, which is connected to the bypass conduit 35.

Different starting conditions occur when the teeth of the starter pinion strike against the faces of the teeth of the flywheel gear 17. When this happens air pressure in the supply conduit to the actuator 14 rises to about 4 bar, and the relief valve 37 connected via the normally open auxiliary control valve to the intake port of the starter motor, opens. Upon the opening of the relief valve 37 a pressure balance is established between the air channels of the channels, bores, conduits, at the both sides of the relief valve 37,and the air pressure in the air supply conduit 22 to the actuator 14 drops to about 1 bar whereby the relief valve is returned to its closed position. At the same time, due to the pressure decrease in the actuator 14 the piston and the starter pinion coupled therewith are reset by a small distance away from the teeth of the flywheel gear. Simultaneously, pressure in the conduit between the main control valve 21 and the starter motor 3 is increased approximately in a reverse proportion to the combined air volume of all conduits at both sides of the relief valve.

The resistance-to-flow element 90 in the embodiment of FIG. 3 is formed so that it is utilized in the reverse flow during the cycle. A remaining pressure in the outlet line can be formed with the aid of this resistance-to flow element 90, which pressure will be so high that the rotors will rotate during the actuation process in the direction counter to that of the start.

The resistant-to-flow element is known and can be formed as an exhaust throttle of a motor vehicle engine, which throttle is positioned in an exhaust conduit and is provided with a switchable flap, by means of which a higher braking effect can be obtained. Such a resistance-to-flow element is disclosed in German publication "Dobbels Taschenbuch für den Machinenbau" by F. Sass, Ch. Bouche and A. Leither, 1966, Berlin, Heidelberg, New York.

The resistance-to-flow element 90 of FIG. 3 can be also formed as a membrane. Such a membrane is disclosed in Düsterloh Catalog, page 115–301.1. The resistance-to-flow element may be formed as an exhaust valve with a sealing plate which is closed during the engine cycle. The exhaust valve in the closed condition forms a very intensive resistance to flow, which after the opening of the exhaust valve during the start of the starter is reduced to a very small value.

In operation, the resistance-to-flow element ensures that a pressure air impulse which occurs at the exhaust side would produce high pressure sufficient for the rotation of the starter in the counter direction. This effect can be achieved by any conventional type of resistance-to-flow elements.

Figure 4:
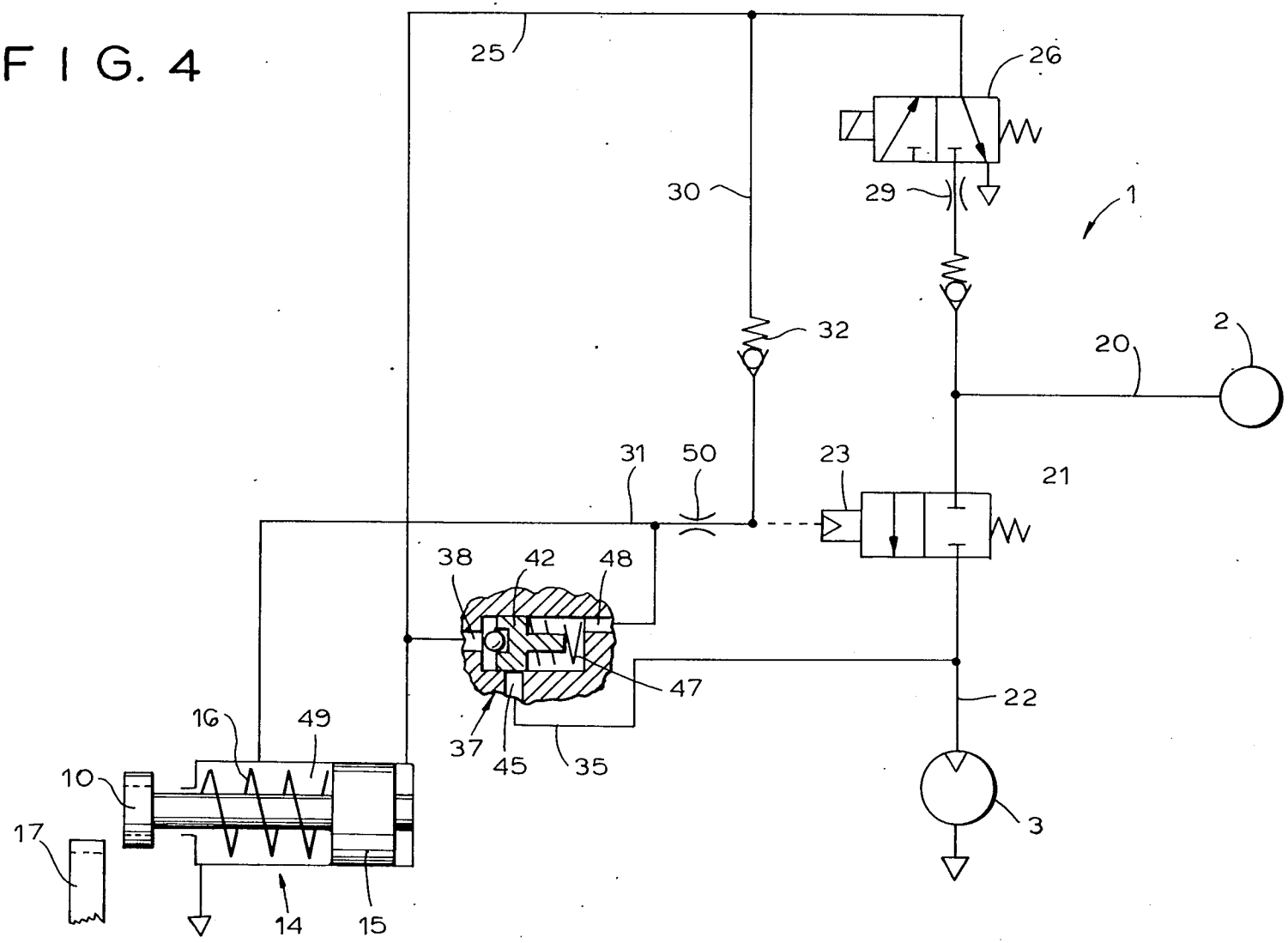
FIG. 4 is a circuit diagram of another embodiment of the pneumatic starter arrangement of this invention.

The beforementioned pressure relief in the spring chamber 47 of the relief valve 37 takes place also in the embodiment according to FIG. 4. In this embodiment the pressure relief is effected via the switching conduit 31 and the spring space 49 of the pneumatic actuator 14. When the piston 15 of the actuator 14 is fully displaced against the biasing spring 16, that means when the starter pinion 10 is fully engaged, full pressure from the supply conduit 25 is applied via the switching conduit 31 to the spring space 47 of the relief valve. As a result, piston 42 of the relief valve closes the connection between the intake port 38 (see FIG. 5) and the exhaust bore 45. In this embodiment, the auxiliary two/two directional control valve 34 used in the embodiments of FIGS. 1 through 3 can be dispensed with even if the starter arrangement 1 is used for "cranking" of a diesel engine. As it has been mentioned before, an additional throttle 50 is required in the switching conduit 31 (FIG. 4) in order to prevent a pressure drop in the conduit 31 and in the supply conduit 25 during the opening of the main control valve 21, thus preventing an undesired retrieval of the piston 15 of the actuator 14. The relieving conduit 30 with back pressure valve 32 must be connected to the switching conduit 31 between the throttle 50 and the switching connection 23 of the main control valve 21.

Figure 5:
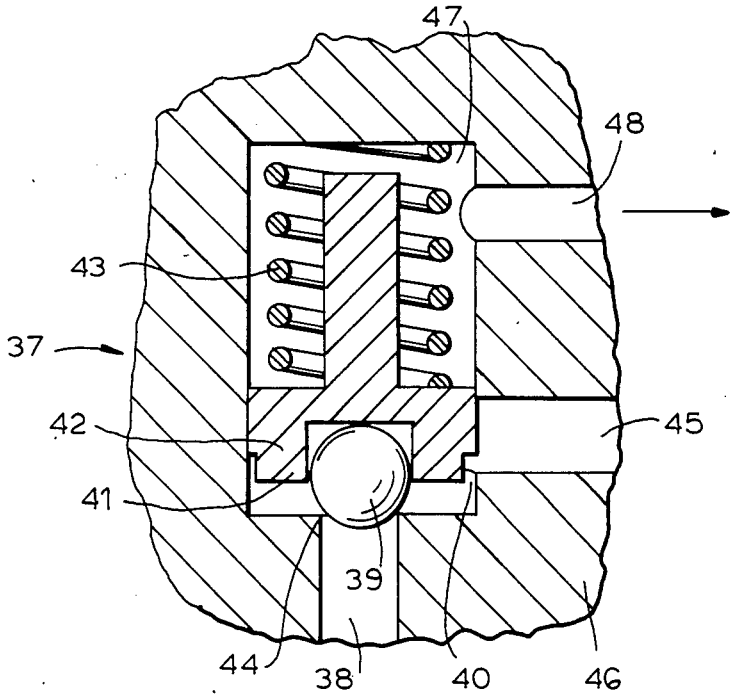
FIG. 5 shows on an enlarged scale a section of a cutaway part of an embodiment of the pressure relief valve in the starter arrangement of this invention.
Figure 6:
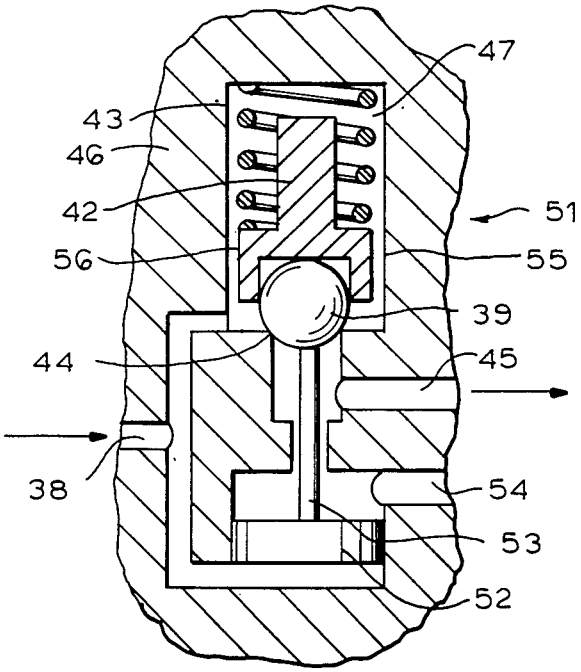
FIG. 6 shows on an enlarged scale a section of a cutaway part of another embodiment of the pressure relief valve.

FIG. 6 illustrates a structural modification 51 of the pressure relief valve. In this embodiment, the bleeder air gap 40 on the piston 42, illustrated in the embodiment of FIG. 5, is eliminated, and the closing body 39 when the opening pressure is exceeded, is displaced by an additional opening piston 52 provided with an actuator rod 53. This relief valve variation can be employed both in the embodiment of this invention according to FIGS. 1 and 5, as well as according to FIG. 4. In the latter case, the conduit 31 is connected to the bore 54. The spring space 47 and the intake bore 38 in this embodiment are interconnected via an annular gap 55 between the piston 42 and the housing 46 or by axial grooves 56 in the piston so that the same pressure is present in the spring space 47 and in the space 78.

Figure 7:
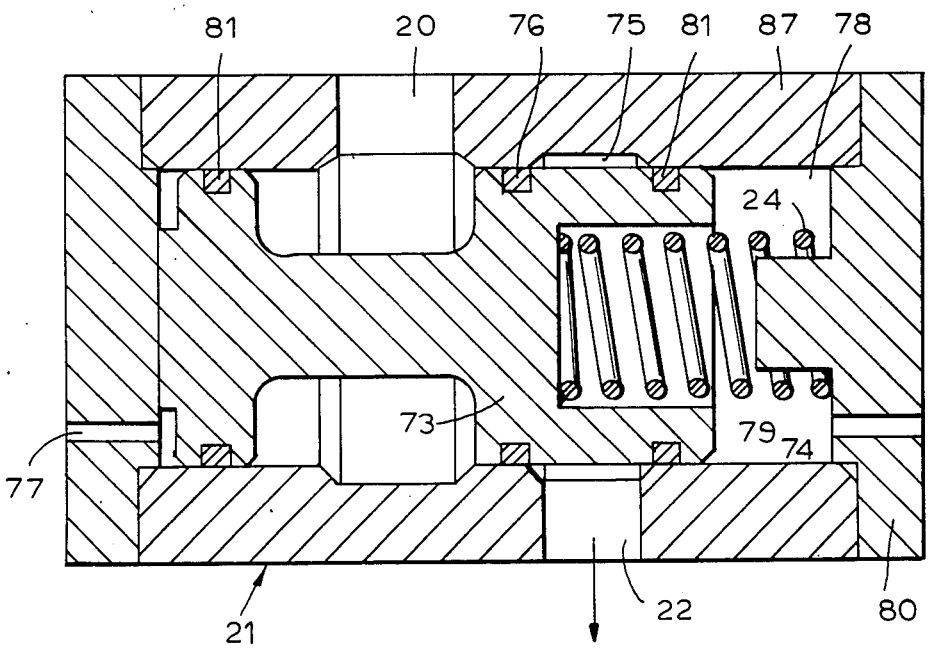
FIG. 7 illustrates in an axial section an embodiment of the main control valve, shown on an enlarged scale.
Figure 8:
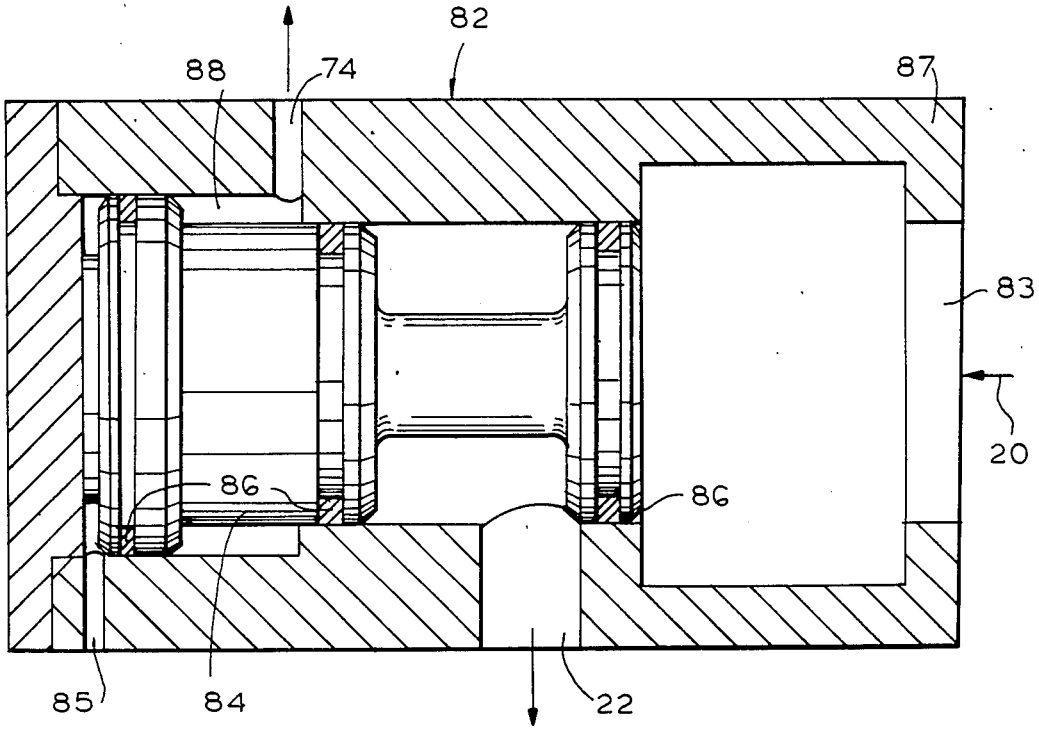
FIG. 8 shows on an enlarged scale another embodiment of the main control valve.

An example of main control valve 21 illustrated in FIG. 7 includes a slider 73 moving relatively slowly in the bore 78 of the housing body 87. The movement of the slider 73 is adjustable by the suitable configuration of a damping bore 74. These adjusting movements are made possible because neither the opening nor the closing function of the main control valve is affected by pressures in the main supply conduit 20 or in the pressure conduit 22. An annular space 75 which is connected to the pressure conduit 22 is relatively small. In this manner the extraction of elastomeric sealing elements 76 in the slider is reliably prevented and the elastomeric sealing elements 76 do not slide over sharp edges of the discharges port leading to the pressure conduit 22. Reference numeral 77 denotes a port which corresponds to the switching connection to the conduit 31 (FIGS. 1 to 4). The damping bore 74 leads to the part of the central bore 78 which accommodates the biasing spring 24. The spring 24 is supported in a recess 79 in the end face of the slider 73 and at its other end rests on a housing collar 80 of the main control valve. Additional elastomeric sealing elements 81 are provided near the ends of the slider 73. In the embodiment of the main control valve 82 illustrated in FIG. 8 the pressure air inlet port 83 is arranged axially. Instead of a slider, there is provided a stepped piston 84. To open the valve, the switching conduit 31 is connected to the switching bore 85. Since pressure air is always present in the main supply conduit 20 connected to the intake port 83, resettling spring can be dispensed with since pressure air supplied through the port 83 always displaces the piston into its extreme right hand position when no pressure is present in the switching conduit 31. Reference numeral 86 denotes sealing elements sealing the stepped piston 84 against the valve housing 87. The annular space 88 between the stepped piston 84 and the housing 87 is provided with a damping bore 74. The valve housing 87 is closed by a lid 89.

Figure 9:
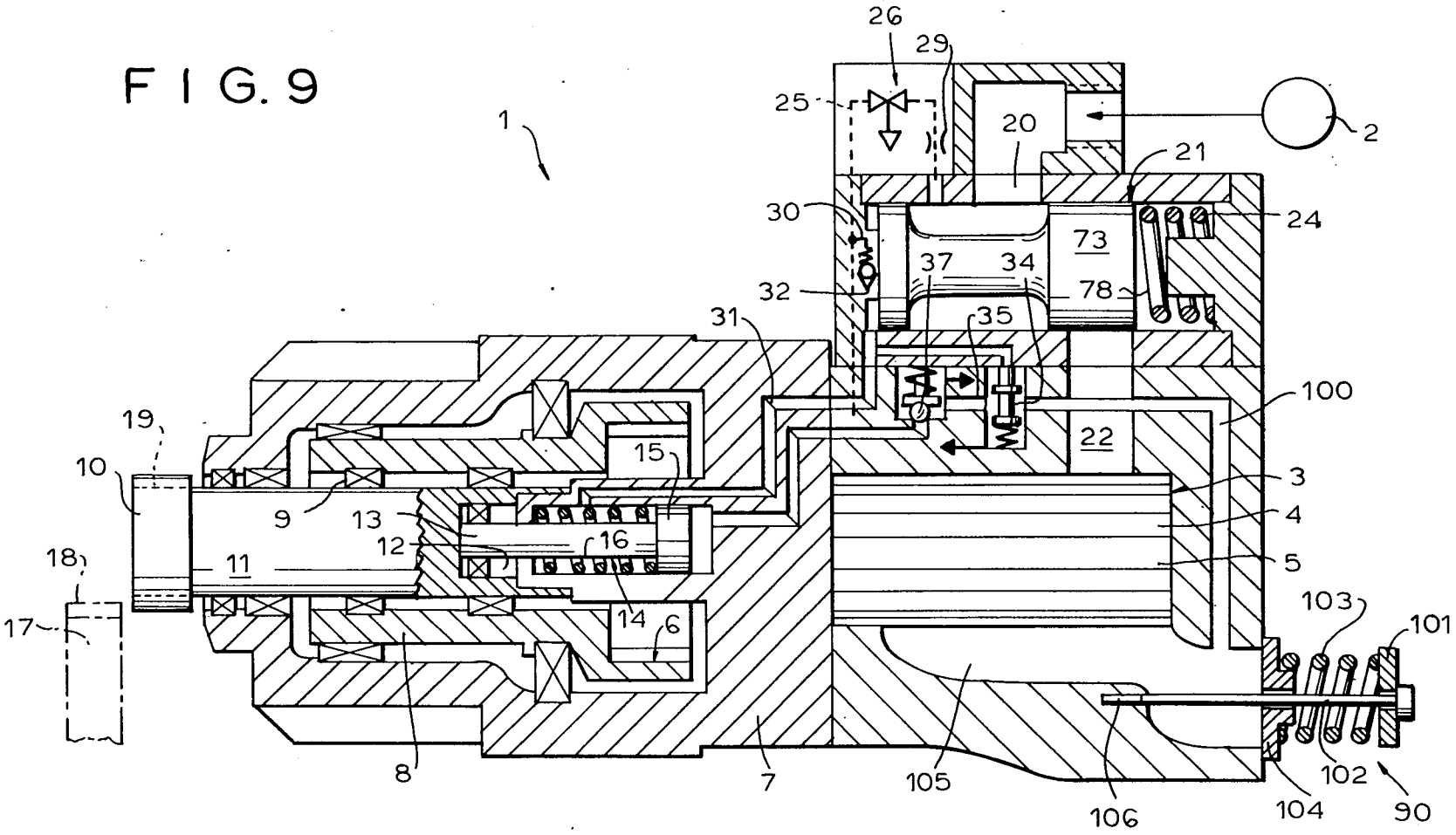
FIG. 9 is an axial section of an another example of an actual embodiment of the starter arrangement of FIG. 2.

In the embodiment of FIG. 9 (starter in FIG. 2 and circuit diagram of FIG. 3) a conduit 100 of the 2/2 valve 34 opens directly into the exhaust duct 105. If pressure pulses enter the exhaust duct 105 from the connecting conduit 1OO, the resistance of flow element 90 causes a pressure rise within the exhaust duct, the pressure then moving the rotors 4, 5 in a direction which is opposite to the subsequent starting direction of rotation.

The resistance to flow element 90 is in the form of an exhaust shutter. A disc member 104 is movably supported on a support pin 102 and may be displaced against the force of a spiral spring 103. The support pin 102 is fixed the housing 7 by means of a thread 106. A plate 101 acts as a support for spiral spring 103. The resistance to flow element 90 is sufficient to cause a pressure within the exhaust duct 105 which is sufficient to move the rotors 4, 5 into the opposite direction. However, he does not generate throttle losses during starting of the starter after nesting has been completed. Such throttle losses might reduce the performance of the starter significantly.

It will be understood that each of the elements described above, or two more together, may also find a useful application in other types of constructions differing from the types described above.

While the invention has been illustrated and described as embodied in a specific examples of the pneumatic starter arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a pneumatic starter arrangement for use in connection with an internal combustion engine having a flywheel gear (17), comprising a pneumatic starter motor (3), an axially retrievable pinion (19) engageable with the flywheel gear, a pneumatic actuator (14) having a spring-biased piston (15) coupled to the pinion (19) for imparting the axial motion to the latter, a supply branch conduit (25) connecting a pressure supply source (2) to the actuator, a main supply conduit (22) connecting the pressure supply source to the starter motor, a main control valve (21) provided in the main supply conduit, a pilot valve (26) provided in the supply branch conduit between the pressure supply source and the actuator (14), means for controlling the position of the main control valve in response to the position of the piston of the pneumatic actuator, and a bypass conduit (35) connecting the starter motor to the supply branch conduit, the improvement comprising a relief valve (37) positioned in said bypass conduit and being designed such that its opening pressure is substantially greater than its closing pressure, and resistance-to-flow means (90) connected to said bypass conduit and arranged at an exhaust side of the starter motor, the ratio of combined air volumes of all pressure air conduits between the starter motor, the main control valve and the relief valve and between the starter motor and the resistance-means and the pressure-relief valve on the one side, and the pilot valve, the pneumatic acutator and the relief valve, on the other side, being between 3:1 and 15:1.

2. A pneumatic starter arrangement as defined in claim 1, wherein the opening pressure of the relief valve is about twice to six times as much as the closing pressure of the latter.

3. A pneumatic starter arrangement as defined in claim 1, wherein the ratio of air volumes in all channels, bores, conduits, and the like between the starter motor, the main control valve and the relief valve on the one side, and the pilot valve, the pneumatic actuator and the relief valve on the other side is about 4:1.

4. A pneumatic starter arrangement as defined in claim 1, further comprising a throttle arranged in the supply branch conduit between the pilot valve and the source of pressure air.

5. A pneumatic starter arrangement as defined in claim 1, further comprising a two/two auxiliary control valve arranged in the bypass conduit between the relief valve and the starter motor, said main control valve being spring biased into its closing position and said auxiliary control valve being spring biased into its open position, said means for controlling the position of the main control valve including a switching conduit, a port formed in the pneumatic actuator and connected to the switching conduit so as to apply full pressure from the supply branch conduit to the switching conduit when the piston of the actuator displaces the starter pinion into its fully engaged position with the flywheel gear, and both the main control valve and the auxiliary control valve each having a switching connection connected to the switching conduit for opening the main control valve and closing the auxiliary control valve when pressure is applied to the switching conduit during the engagement of the starter pinion.

6. A pneumatic starter arrangement as defined in claim 1, further comprising a switching element between said main control valve and said pneumatic actuator, and a back pressure valve connected between the supply branch conduit and the switching conduit.

7. A pneumatic starter arrangement as defined in claim 1, wherein the relief valve includes a housing formed with an inlet port and an outlet port, a spring biased piston movable opposite the inlet port and past the outlet port and a closing body supported on the piston for closing or opening the inlet port.

8. A pneumatic starter arrangement as defined in claim 7, wherein the ratio of the sealing surface of the closing body to the area of the piston of the relief valve attacked by pressure air is between 1:2 and 1:10.

9. A pneumatic starter arrangement as defined in claim 7, wherein the piston of the relief valve is formed with a narrow bleeder gap to pass a small air flow from the inlet port to the outlet port in the closed position of the valve.

10. A pneumatic starter arrangement as defined in claim 7, wherein the housing of the relief valve has a spring space for accommodating the biasing spring for the piston, and a pressure relieving channel connecting the spring space with the outer atmosphere.

11. A pneumatic starter arrangement as defined in claim 7, further comprising an additional piston communicating with the inlet port and being provided with a piston rod engaging the closing body to displace the same into an opening position.

12. A pneumatic starter arrangement as defined in claim 11, wherein the housing of the relief valve defines a spring space for accommodating biasing spring for the piston, the spring space communicating with the inlet port via an annular gap between the housing and the piston or via axial grooves in the piston, and the space of the valve between the additional opening piston and the closing body being provided with a first channel leading to the bypass conduit and a second channel leading to the switching conduit.

13. A pneumatic starter arrangement as defined in claim 1, wherein the main control valve includes a housing, a slider guided in the housing and being provided with elastomeric sealing elements, and a biasing spring arranged in a recess in one end of the slider.

14. A pneumatic starter arrangement as defined in claim 13, wherein the housing includes an intake port connected to the main supply conduit, an annular inner groove communicating with the supply conduit and being leakage frees sealed off by the elastomeric sealing element when the main control valve is its closed condition.

15. A pneumatic starter arrangement as defined in claim 14, wherein the part of the housing of the main control valve accommodating the biasing spring communicates with the outer atmosphere via a damping channel.

16. A pneumatic starter arrangement as defined in claim 1, wherein the main control valve has a housing formed with an axial intake port and a stepped piston.

17. A pneumatic starter arrangement as defined in claim 5, wherein the opening pressure $P_o$ of the relief valve is between 40 and 80 percent of the switchover pressure $P_3$ of the main control valve; the closing pressure $P_1$ of the relief valve is between 17 and 50%, preferably about 25% of the opening pressure $P_o$; the switchover pressure $P_2$ of the auxiliary control valve being between 12 and 50%, preferably about 38% of the opening pressure $P_o$; the switchover pressure $P_3$ of the main control valve being about 15 to 90%, preferably about 50% of the opening pressure whereby the switchover pressure $P_3$ being larger than the switchover pressure $P_2$; the biasing spring equivalent $P_4$ of the pneumatic actuator being in disengaged condition of the starter pinion about 20 to 60%, perferably about 50% of the opening pressure $P_o$, whereby the spring equivalent $P_4$ being greater than the closing pressure $P_1$ of the relief valve; the biasing spring equivalent $P_5$ of the pneumatic actuator in the engaged condition of the starter pinion being about 30 to 90%, preferably about 75% of the opening pressure $P_o$; and the biasing force $P_6$ of back pressure valve being about 5% of the opening pressure $P_o$.

18. A pneumatic starter arrangement as defined in claim 17, wherein the opening pressure $P_o$ of the relief valve is 4 bar, the closing pressure $P_1$ of the relief valve is 1 bar, the biasing spring equivalent $P_4$ of the pneumatic actuator in disengaged condition of the starter pinion is 2 bar, the biasing spring equivalent $P_5$ of the pneumatic actuator in engaged condition of starter pinion is 3 bar, the switchover pressure $P_2$ of the auxiliary control valve 1.5 bar, the biasing force $P_6$ of the back pressure valve is 1.2 bar, the switchover pressure $P_3$ of the main control valve is 2 bar, and the ratio of air volumes of all conduits before and after the relief valve being 4:1.

* * * * *